US006571946B2

(12) United States Patent
Fiore, Jr.

(10) Patent No.: US 6,571,946 B2
(45) **Date of Patent: *Jun. 3, 2003**

(54) CASE FOR ARCHERY EQUIPMENT

(75) Inventor: Joseph F. Fiore, Jr., Lebanon, PA (US)

(73) Assignee: Plano Molding Company, Plano, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,914

(22) Filed: Apr. 11, 2002

(65) Prior Publication Data

US 2003/0080008 A1 May 1, 2003

Related U.S. Application Data

(63) Continuation of application No. 09/694,187, filed on Oct. 23, 2000, now Pat. No. 6,390,294.

(51) Int. Cl.[7] ..... B65D 85/00; F41B 5/22

(52) U.S. Cl. ..... 206/315.11; 206/579

(58) Field of Search ..... 124/25.5, 25.7; 220/4.01, 4.02, 600, 4.21; 224/916; 206/315.11, 317, 443, 579; 211/60.1

(56) References Cited

U.S. PATENT DOCUMENTS

| | | | | |
|---|---|---|---|---|
| 3,088,583 A | | 5/1963 | Holtz | |
| 3,337,028 A | | 8/1967 | Glavan | |
| 3,351,270 A | | 11/1967 | Hohnjec | |
| 3,421,682 A | | 1/1969 | Eisenbach | |
| D246,138 S | | 10/1977 | Christensen et al. | |
| 4,854,476 A | * | 8/1989 | Serio, Jr. | 220/4.02 |
| 5,242,050 A | | 9/1993 | Billings | |
| D343,057 S | | 1/1994 | Dickinson | |
| D358,254 S | | 5/1995 | VanSkiver | |
| 5,456,379 A | | 10/1995 | Krupa et al. | |
| 5,775,313 A | | 7/1998 | Bresette et al. | |
| 5,803,069 A | | 9/1998 | Schreiber | |
| 5,848,718 A | * | 12/1998 | Colwell | 220/4.02 |
| 6,193,089 B1 | * | 2/2001 | Yu | 220/4.21 |

OTHER PUBLICATIONS

Doskocil Mfg. Co. 1995 Gun Guard Quality Sporting Cases Catalog, p. 13 (Archery Edition).

Woodstream (an EKCO Group Company) 1991 Hunting and Shooting Acessories Catalog (Inside cover—Field Locker), p. 2.

Kolpin Mfg., Inc. 1997 Hunting Products Catalog, p. 15 (Gator Hard–Sided Bow Cases).

* cited by examiner

*Primary Examiner*—Jim Foster
(74) *Attorney, Agent, or Firm*—Vedder, Price, Kaufman & Kammholz

(57) ABSTRACT

A case for archery equipment includes, interengaging first and second half portions connected for movement between open and closed positions. The first half portion includes a first wall defining a first interior recess and having a first mating rim. The first half portion further includes a plurality of first supports formed in the first wall, and located within the first interior recess. The second half portion includes a second wall defining a second interior recess and having a second mating rim. The second half portion further includes a plurality of second supports formed in the second wall and located within the second interior recess. Each first support has a first longitudinal axis and is aligned along a common first axis which intersects each first longitudinal axis normally within and defining a first common plane. Each second support has a second longitudinal axis and is aligned along a common second axis which intersects each second longitudinal axis normally within defining a second and common plane. The first and second planes are parallel and offset in the open position and aligned in opposition in the closed position such that each first support engages each said second support in mating contact. A load applied to the case in a closed position is distributed among the first and second supports and the first and second mating rims, resulting in a protective zone defined by the first and second interior recesses.

28 Claims, 3 Drawing Sheets

CASE FOR ARCHERY EQUIPMENT

This is a continuation of prior application Ser. No. 09/694,187, filed Oct. 23, 2000, U.S. Pat. No. 6,370,294 which is hereby incorporated herein by reference in its entirety.

BACKGROUND OF THE INVENTION

The present invention relates generally to a case for archery equipment, and more particularly, to a molded, protective case which is adapted for easy, low-cost mass production manufacture and which prevents damage to the equipment stored therein, by even distribution of loads and forces thereupon.

Transporting archery equipment, such as bows and arrows, has always been a difficult undertaking. By their very nature, the equipment is large and cumbersome. The equipment is also relatively delicate in comparison to its size. In particular, modern bows have very complex structure in order to provide the sophisticated functions now expected. While a bow may be disassembled for transportation, it is considered a major disadvantage if this is necessary. Accuracy is lost if these bows are disassembled. However, the bows and arrows are also very delicate when subjected to forces different from those of ordinary operation. Slight or unseen damage to bows can result in catastrophic failure of the equipment, which could even injure the user. Arrow shafts are preferably made from very thin wall aluminum tubing or carbon fiber. The slightest tweak, curve or bend in the arrow shaft will cause the arrow to fly off course when in use, or with carbon fiber, an off-axis impact can destroy the arrow shaft. Consequently, it is advantageous to use a protective case which can prevent any damage to the implements therein from forces and loads applied thereto.

Current standard protective measures include fabric, soft-sided, padded cases, and traditional, rectangular suitcase-style cases. For many reasons, there are obvious disadvantages to the soft-sided cases. First, and foremost, is the lack of protection afforded the equipment inside. These cases are useful only in that all of the equipment may be transported in one case. As a result, they have rather limited usefulness for serious archers, or those concerned about the condition of their equipment. Accordingly, they are priced on the lower end of the scale. It should be appreciated that although the sides of the case are padded, the large side panels easily deform when subjected to external loads or forces and only protect the equipment from abrasion or minimal force impacts, such as setting the case down. Without a stiff exterior panel, the level of protection afforded is only sufficient for the infrequent or occasional user.

The traditional suitcase design for archery equipment provides more protection for the contents. Commonly, their construction includes a plastic shell having an extruded metal band affixed about the perimeter of each half of the shell, and a metal piano-style hinge joining the halves together. One disadvantage is the size of such a case. Available only in conventional rectangularly-shaped designs, there is a considerable amount of extra space that is not used which renders the case cumbersome and unweildly. Another major disadvantage is the sizable planar side panels. The shape of a bow requires a case with large side panels relative to the ends. As a result, the sides of the case easily deform inward when subjected to an external load or force. The side panels of such known cases are not designed to absorb or distribute significant impact forces. The perimeter edges are designed to carry the loads; however, the metal bands are easily damaged and as such misalignment is common. As a result, known suitcase designs permit deformation of the side panels to the extent that the bow and/or arrows can be damaged, and create haphazard load distributions.

The advent of carbon fiber arrow shafts resulted in a lighter, stiffer arrow with a much thinner shaft. Previous quiver or arrow holder designs produced over the last 40-plus years are sized for the much larger aluminum arrow shafts. As a result, they are unable to properly secure the carbon fiber arrows in position for transportation or use. Consequently, archers must purchase a quiver for each type of arrow shaft, totally convert to the new arrow shafts, or not use the new arrow shafts. Other types and kinds of arrow holders have faced similar disadvantages.

Transporting or storing bows inside either of the above prior art cases has obvious disadvantages; namely, the inability to ensure proper alignment and to protect the bow from damage by external forces. Consequently, all previous design attempts to provide an adequate protective enclosure have failed. Likewise, transporting or storing arrows inside the above-described cases has obvious disadvantages, namely, the inability to protect the arrow shafts from bending or breaking due to their weak designs. Consequently, all previous design attempts to incorporate an arrow holder with or inside a case have failed to provide adequate protection.

Therefore, there is a significant demand for a durable, protective case for safely transporting or storing archery equipment which provides the advantages of low-cost, high-strength, impact-resistance, load distribution, automatic alignment and a multi-functional use.

SUMMARY OF THE INVENTION

It is therefore a general object of the present invention to provide a protective case for the transportation and/or storage of archery equipment which is inexpensive, yet impact resistant, non-deformable, sturdy and durable.

Another object of the present invention is to provide a case which has an interior cavity dimensioned to receive an archery bow and a plurality of arrows.

Yet another object of the present invention is to provide a protective bow case which resists and distributes deforming forces impacting on the comparatively large panels.

Still another object of the present invention is to provide a protective case with reinforcing pillars which brace and prevent the comparatively large panels from significantly deforming from their original location.

Another further object of the present invention is to provide a protective bow case with integrally molded reinforcing pillars which cooperate to inhibit deformation of the comparatively large panels by effectively reducing the flexibility of the large panels and distributing any loads or forces impinging on the case.

Yet another further object of the present invention is to provide a case with an integrally molded reinforcing pillars formed in each half of the enclosure which each cooperate and interconnect when the case is in a closed position to reduce the flexibility of the large panels of the case from damaging deformation and to distribute any loads or forces impinging on the case.

Still yet another further object of the present invention is to provide a protective case for the transportation and/or storage or archery equipment which has an inexpensive, easy to manufacture, integratable, and simple-to-use arrow holder.

Another object of the present invention is to provide an arrow holder which securely mounts arrow shafts having two different diameter dimensions.

Yet another object of the present invention is to provide a first groove for removably securing two differently sized arrow shafts in an interfering manner which has second grooves formed therein to provide adequate flexure of the first groove such that the arrow shafts are not damaged when inserted into or removed from the first groove.

The present invention accomplishes these and other objects by way of its novel and unique structure, utilizing the following means to solve the aforementioned problems. In one principal aspect of the present invention, a case for archery equipment includes interengaging first and second case sections connected for movement between open and closed positions. The first case section includes a first wall defining a first interior recess and having a first mating rim. The first case section further includes a plurality of first reinforcing pillars formed in the first wall, and located within the first interior recess. The second case section includes a second wall defining a second interior recess and having a second mating rim. The second case section further includes a plurality of second reinforcing pillars formed in the second wall and located within the second interior recess. Each first reinforcing pillar has a first longitudinal axis and is aligned along a common first axis which intersects each first longitudinal axis normally within and defining a first common plane. Each second reinforcing pillar has a second longitudinal axis and is aligned along a common second axis which intersects each second longitudinal axis normally within defining a second and common plane. The first and second planes are parallel and offset in the open position and aligned in opposition in the closed position such that each first reinforcing pillar engages each said second reinforcing pillar in mating contact. A load applied to the case in a closed position is distributed among the first and second reinforcing pillars and the first and second mating rims, resulting in a protective zone defined by the first and second interior recesses.

In another principal aspect of the present invention, an arrow holder is adapted for mounting within a case for archery equipment, where the case includes interengaging first and second case sections where each case section has a respective first and second interior recess, including at least one comb number having a plurality of alternatively disposed first and second grooves formed therein. The first grooves have a first depth. The second grooves have a second depth which is greater than the first depth. Whereby, the second grooves are configured to removably mount arrow shafts having at least two different diameters.

These and other objects, features and advantages of the present invention will be clearly understood through consideration of the following detailed description.

BRIEF DESCRIPTION OF THE DRAWINGS

In the course of the following detailed description, reference will be made to the attached drawings wherein like reference numerals identify like parts and in which.

DETAILED DESCRIPTION OF THE PREFERRED EMBODIMENT

Figure 1:
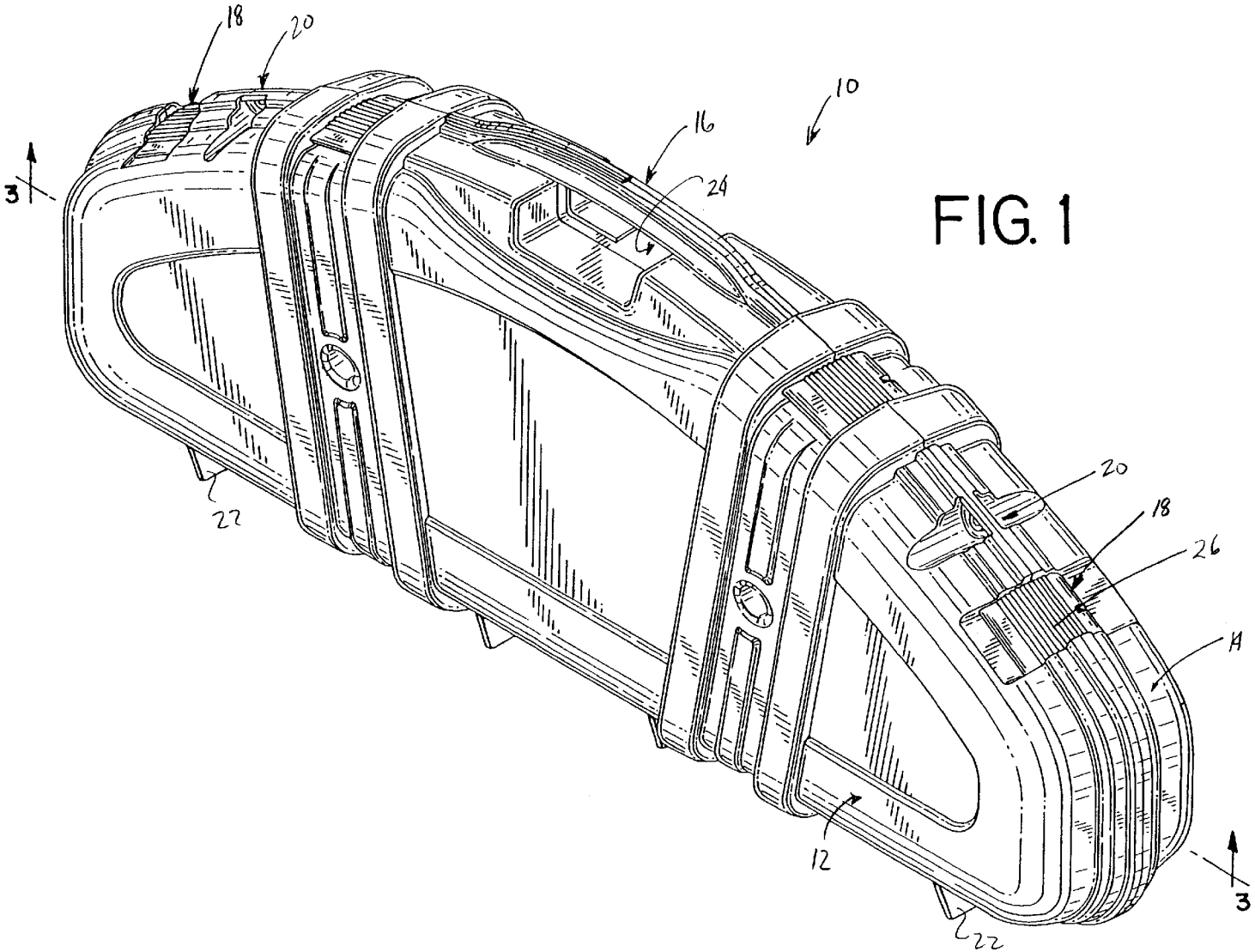
FIG. 1 is a perspective view of the case for archery equipment constructed in a closed position in accordance with the principles of the present invention.

The present invention relates to a protective case for transporting and/or storing archery implements, preferably at least a bow and a plurality of arrows. Generally, the case 10 of the present invention shown in FIGS. 1–5, includes interengaging case sections, a first case section 12 and a second case section 14 which are interconnected along a hinge line for movement between an open position, FIG. 2, and a closed position, FIGS. 1 and 3. As shown in FIG. 1, the case 10 also includes a handle 16, a plurality of latching devices 18, locking members 20, and a plurality of feet 22.

The handle 16 is formed by cooperation of the first case section 12 and the second case section 14. A passage 24 provided below the handle 16 for receiving the hand or fingers of an operator enables one to carry or move the case 10. Each latching device 18 in FIG. 2 includes an arm 26 and a catch 28. The arm 26 is movably secured to the case 10, and preferably to the second case section 14. The preferred structural components of the arm 26 are conventional, including a release lever 30 and an engagement finger 32. The catch 28 is preferably formed on the first case section 12 and comes into contact with the engagement finger 32 when the arm 26 is moved into a latching position as illustrated in FIG. 1. Pressure applied to the arm 26 forces interlocking of the engagement finger 32 with catch 28. The release lever 30 provides a mechanical advantage for an operator to overcome the interlocking forces between the engagement finger 32 and the catch 28 in order to move the case 10 to an open position. It will be recognized by those having ordinary skill in the art that any other presently available, suitable latching devices may be substituted and achieve the identical function.

The locking members 20 are basically bores 34 formed in each of the first and second case sections 12 and 14 which provide a passage through which an operator may insert a conventional locking element (not shown). Preferably, the locking element is a padlock which is opened by key or combination. The case 10 may not be opened without destroying the case 10, if the locking elements are not removed.

A plurality of feet 22 are provided in association with the first and second case sections 12 and 14 such that the case 10 may be oriented in a free-standing vertical position as shown in FIG. 1. These feet 22 assist an operator in transportation of the case by providing a stable base for maintaining the vertical orientation.

Figure 2:
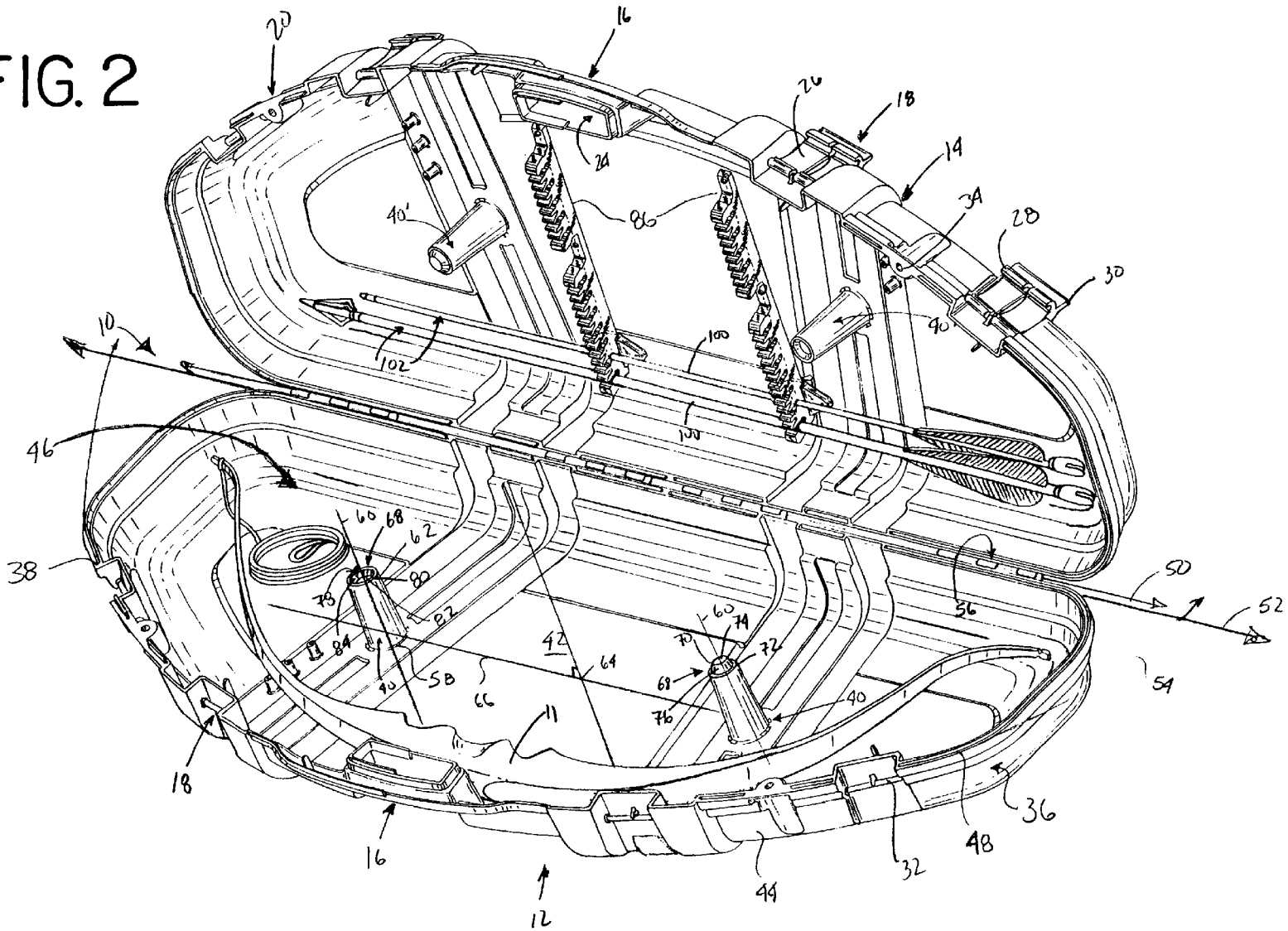
FIG. 2 is a perspective view of the protective enclosure of FIG. 1 in an open position illustrating the interior recesses thereof, and the arrow holders disposed therein.

As shown in FIG. 2, the first case section 12 generally includes a first wall 36, a first mating rim 38, a hinge line 50 and a plurality of first reinforcing pillars 40. The first wall 36 is formed generally as a shell having a generally tub-like configuration. An interior surface 42 and an exterior surface 44 cooperate to define the first wall 36 and the thickness thereof. The first wall interior surface 42 defines a first interior recess or cavity 46 which is configured and dimensioned to receive an archery bow 11 therein. The first mating rim 38 is formed as the substantially circumferentially extending edge 48 of the first wall 36. The configuration of the first mating rim 38 generally represents the overall outline of the case 10. Preferably the configuration of the case 10 and mating rim 38 is generally described as a chord, represented by line 52, intersecting an arc, represented by line 58. It will be recognized by those of ordinary skill in the art that the shape or configuration of the case 10 is not limited to the preferred version and is offered by way of example only. The hinge line 50 is generally coincident with the chord line 52. The first hinge structures 56 are disposed at selected positions on the first mating rim 38 along the hinge line 50. The hinge structures are formed integrally with the first case section 12 and may be configured in any of a number of conventional ways. Snap-fit, projection/receptacle, living, and frangibly created hinges may be used or freely substituted as will be recognized by one of ordinary skill in the art.

Figure 3:
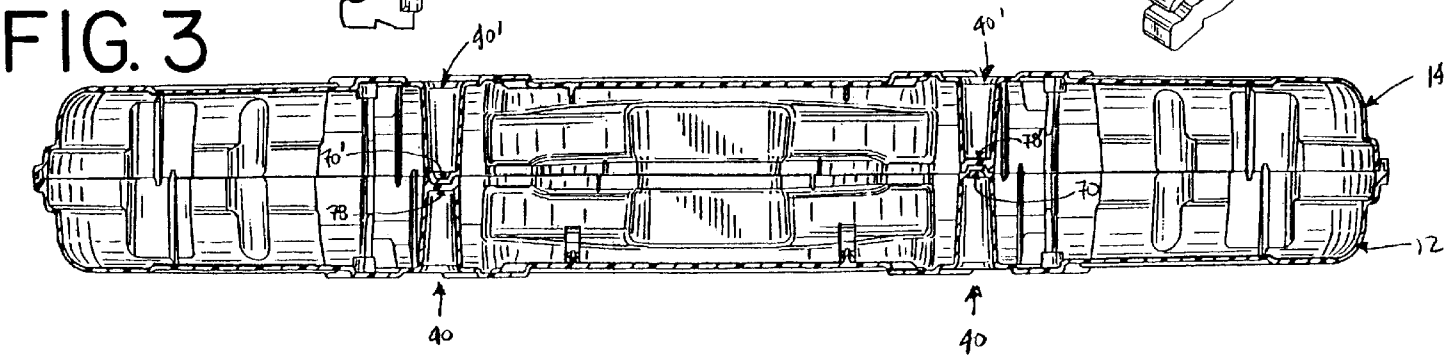
FIG. 3 is a cross-sectional view taken along lines 3—3 of FIG. 1, illustrating the case in a closed position and the reinforcing pillars interengaged.

A plurality of first reinforcing pillars 40 are shown in FIGS. 2 and 3. These reinforcing pillars 40 are formed in or integrally molded with the first case section 12. Generally, each reinforcing pillar 40 is configured as a substantially hollow, tubular projection. Specifically, each reinforcing pillar 40 is formed as a hollow truncated cone. A base 58 is disposed adjacent the interior surface 42. The reinforcing pillar 40 extends away from the interior surface 42 a certain extent generally along a longitudinal axis 60 to a free end 62 thereof. Each reinforcing pillar 40 is disposed within the first interior recess or cavity 46. The pair of reinforcing pillars 40 shown in FIGS. 2 and 3, is the preferred embodiment for the present invention, but those of ordinary skill in the art will recognize and acknowledge that more supports may be added without diverging from the purpose and intent of the subject invention. Each first reinforcing pillar 40 has a first longitudinal axis 60 which is disposed spaced along a common first axis 66 which intersects each first longitudinal axis 60 within and defining a first common plane 64. The common first axis 66 and first common plane 64 are generally parallel to and spaced apart from the hinge line 50.

The free ends 62 of the reinforcing pillars 40 alternately have an interlocking feature 68 formed therein. A projection 70 is preferably disposed on one reinforcing pillar 40 and extends away from the shoulder 72 defined at the free end 62 in a generally truncated cone configuration with a top surface 74 disposed at the furthest extent from the interior surface 42. A conical annular surface 76 connects the annular shoulder 72 with the top surface 74. A cavity 78 is preferably formed in the free end 62 of the other reinforcing pillar 40. A shoulder 80 is defined at the free end 62. A bottom surface 82 is connected to the shoulder 80 by an inverted truncated conical annular surface 84 which extends therebetween. It will be recognized by one of ordinary skill in the art that the angle of the conical annular surfaces 76 and 84 are substantially similar.

The second case section 14 is generally a mirror image of the first case section 12, with the exception of the arrow holders 86. Thus, lengthy discussion of the features of the second case section 14 will be avoided by the use of prime element numerals, such as 40' for the plurality of second reinforcing pillars, in order to discuss the second case section 14. It should be noted however, that there are several differences in structure which will be discussed below.

The structural and positional aspects of the reinforcing pillars 40' of the second case section 14 substantially mirror those reinforcing pillars 40 described in the first case section 12, with the following exception. The projection 70' and cavity 78' of the second case section 14 are respectively in alignment and opposition with the cavity 78 and projection 70 of the first case section 12 when the case 10 is in a closed position. FIG. 3. The cavity 78 and projection 70' and the projection 70 and cavity 78' cooperatively interlock thereby connecting the first and second case sections 12 and 14 such that loads applied to the case 10 are evenly distributed. Thus, the contents, namely bow and arrows, are not damaged. When the case 10 is in the closed position, the coupled reinforcing pillars 40 and 40' also prohibit lateral misalignment of the first and second case sections 12 and 14 whereby the first and second mating rims 38 and 38' are also properly aligned and in opposition.

Figure 5:
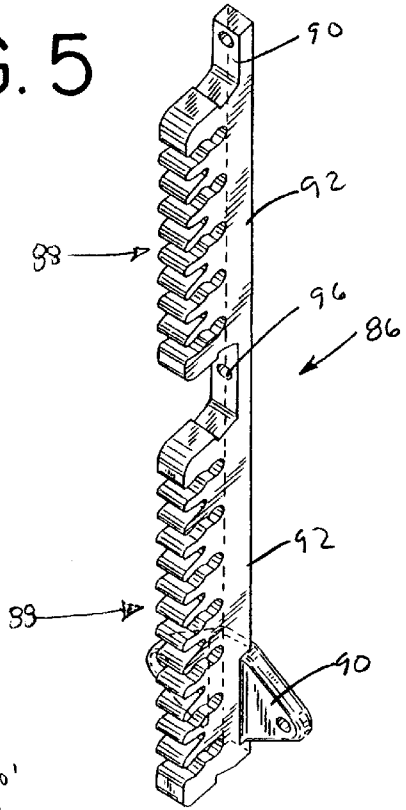
FIG. 5 is a perspective view of the arrow holder of FIG. 4.
Figure 4:
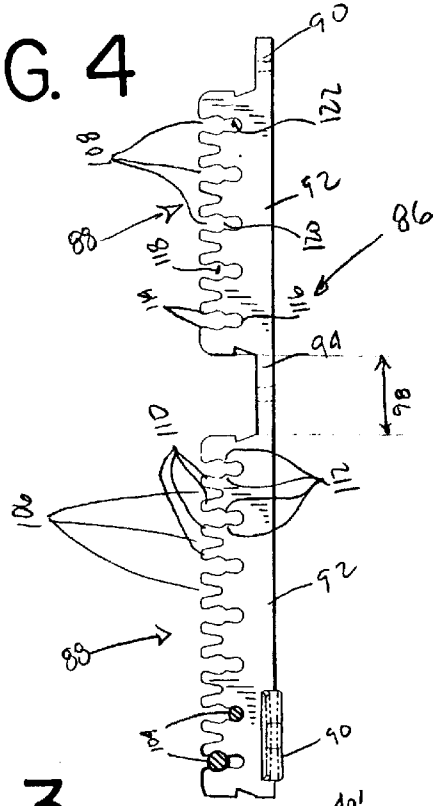
FIG. 4 is a side elevation view of the arrow holder of FIG. 2 constructed in accordance with the principles of the present invention.

A pair of arrow holders 86 are shown in FIG. 2 attached to the second case section 14. Detailed features of the holders 86 are shown in FIGS. 4 and 5. Each arrow holder 86 generally includes a comb-like member 88 and a plurality of mounting flanges 90. The comb member 88 has a pair of base portions 92, each having a plurality of fingers or tines 110 which extend away therefrom to define a plurality of grooves. A mounting element 94 is disposed between the pair of base portions 92 generally formed as a large notch. An aperture 96 is disposed therein for receiving a mounting device to secure the arrow holder 86 to the second case section 14. The aperture 96 is substantially aligned with axis 66 and a width 98 of the notch generally corresponds with the outer diameter 100 of the base end 58' of the reinforcing pillars 40'. Accordingly, arrows 102 do not contact the reinforcing pillars 40'.

The comb member 88 removably mounts a plurality of arrows having a variety of differently sized arrow shafts 104. A plurality of alternately disposed first and second grooves 106 and 108 are defined between adjacent fingers or tines 110. The arrow shafts 104 interferingly engage the second grooves 108. The first grooves 106 have a first depth represented by the extent of arrow D1, and a first width represented by the arrow W1, which vary along the first depth D1. The extent of the first depth D1 and the extent and variance of the first width W1 in combination with the thickness and durometer of the elastomeric material used to form the comb member determines the amount of flexure of the adjacent fingers that define a first groove 106 toward one another when an arrow shaft 104 is inserted into interfering engagement in an adjacent second groove 108.

The second grooves 108 have a second depth represented by the extent of arrow D2, which is greater than the first depth D1, and a second width represented by the arrow W2, which vary along the second depth D2. The second width W2 at the top 114 of the second grooves 108 is greater than the second width W2 at the bottom 116 of the second grooves 108. An intermediate portion 112 of the second grooves 108 has second width W2 less than the second width W2 at the bottom 116 of the second grooves 108. A first chamber 118 is formed near the top 114 of the second grooves 108 generally configured to receive and interferingly engage an arrow shaft 104 having a first diameter D3. The opening to the first chamber 118 is substantially equivalent to the second width W2 at the top 114 of the second grooves 108. The intermediate portions 112 define a lower extent of the first chamber 118 and a passage 120. A second chamber 122 is disposed below the first chamber 118 and communicates therewith by the passage 120. An arrow shaft 104 having a second diameter D4 is interferingly engaged within the second chamber 122 after insertion through the first chamber 118 and the passage 120. The first chamber 118 is larger than the second chamber 122, much like the arrow shaft 104 of a first diameter D3 is larger than the arrow shaft 104 of a second diameter D4.

The mounting flanges 90 are integrally formed or molded from the same elastomeric material as the remainder of the comb member 88. Apertures 124 receive and engage mounting projections molded or formed in the second half portion 14. Thus, the comb member 88 is positively retained within the second interior recess.

In use, the case 10 in closed position is opened by pulling the release lever 30 on each latch 18 with sufficient force to overcome the interconnection force between the engagement finger 32 and the catch 28. Accordingly, each latch 18 may be disconnected. The second case section 14 may then be moved through an arc of at least 180° in order to place the case in an open position. An archery bow 11 may then be secured within the first interior recess 46 for protective storage or transportation. Arrows 102 having arrow shafts 104 of different diameters may be secured in the arrow holder 86 located in the second case section for protective storage or transportation. In order to protect the contents of the case 10 namely the bow and arrows, the case 10 must be moved into a closed position. The second case section 14 may then be moved about the hinge line 50 until mating contact is made between the reinforcing pillars 40 and 40', and the mating rims 38 and 38'. The projections 70 and 70' interlock with the corresponding cavities 78' and 78, respectively, in order to automatically align the mating rims 38 and 38'. The latches 18 may then be engaged to secure the first and second case sections 12 and 14 together. Any load or force imparted to the case 10 is then distributed evenly among the reinforcing pillars 40 and 40' and the mating rims 38 and 38'. Advantageously, the mating rims 38 and 38' are prevented from misalignment during an impact or load by the interlocked reinforcing pillars 40 and 40'.

Thus, it will be apparent that the bow case 10 includes a first half 12 and a second half 14 formed as first and second case sections connected in clamshell fashion such that the first and second case sections 12 and 14 are moveable between an open position shown in FIG. 2 and a closed position shown in FIGS. 1 and 3. It will be further apparent that the first and second case sections 12 and 14 each respectively define interior cavities 78 and 78' which jointly define an interior storage compartment when the case 10 is closed. Still further, it will be apparent that each of the first and second case sections 12, 14 has a plurality of reinforcing pillars 40 and 40' defined as sets of reinforcing pillars affixed to respective first and second case sections to project into the storage compartment when the first and second case sections 12 and 14 are closed. The reinforcing pillars 40 and 40' have free ends 62, 62'. It will be apparent that each set of reinforcing pillars 40, 40' includes at least one reinforcing pillar configured as a female reinforcing pillar and at least one configured as a male reinforcing pillar, each male pillar being aligned and in registry with a female pillar when the case sections 12 and 14 are closed, that the free end 62, 62' of each female reinforcing pillar has a cavity 78 defining a recessed portion, and the free end 62, 62' of each male reinforcing pillar has a projection 70 defining a projection portion configured to be snugly received within the recessed portion when the case sections 12 and 14 are closed.

While the preferred embodiments of the invention have been shown and described, it will be apparent to those skilled in the art that changes and modifications may be made therein without departing from the spirit of the invention, the scope of which is defined by the appended claims.

I claim:

1. A case comprising:

first and second case sections connected for relative movement between open and closed positions and jointly defining an interior compartment when closed; and arrow holding means disposed within said compartment for releasably holding a plurality of arrows of differing shaft thickness; said holding means including at least one comb member connected to at least one of the first and second case sections, each said comb member including a main body portion having a plurality of grooves formed therein, each of said grooves having a closed end, an open end and a first chamber adjacent open end, a second chamber adjacent said closed end, and a narrowed passage between said first chamber and said second chamber, wherein the first chamber is configured to snugly receive an arrow having a first shaft thickness and the second chamber is configured to snugly receive an arrow having a second shaft thickness differing from said first shaft thickness.

2. The case as recited in claim 1, further including a set of reinforcing pillars contiguous with each of the first and second case sections which project into an interior compartment defined when the first and second case sections are disposed in the closed position.

3. The case as recited in claim 2, wherein each of the reinforcing pillars has a free end which is defined substantially in a plane.

4. The case as recited in claim 2, wherein each reinforcing pillar has a free end such that the free end of each of the reinforcing pillars formed in the first case section is aligned with and abuts the free end of one of the reinforcing pillars formed in the second case section when the first and second case sections are disposed in the closed position.

5. The case as recited in claim 4, wherein each reinforcing pillar includes a projection and a shoulder defined at the free end.

6. A case comprising:

first and second case sections connected for relative movement between open and closed positions and defining an interior compartment when in the closed position;

the first case section including a first wall defining a first interior recess and having a first mating rim;

the second case section including a second wall defining a second interior recess and having a second mating rim;

the first and second mating rims having a structural configuration substantially defined by a chord portion, intersecting an arc portion;

the first and second case sections each having a set of reinforcing pillars integrally formed therein projecting into said interior compartment when the first and second case sections are disposed in the closed position, each of said pillars having a free end;

the free end of each reinforcing pillar of the first of said sections being aligned with the free end of one of the reinforcing pillars formed in the second case section when the first and second case sections are disposed in the closed position, wherein each reinforcing pillar is generally configured as a truncated cone.

7. The case as recited in claim 6, further including a handle formed along the arc portion of each first and second case section to define a passage when the first and second case sections are disposed in the closed position.

8. The case recited in claim 6, further including at least one comb member connected to at least one of the first and second case sections for removably mounting a plurality of arrows.

9. The case as recited in claim 6, further including a plurality of feet formed on the first and second case sections for supporting the case in an upright orientation when the first and second case sections are disposed in the closed position.

10. The case as recited in claim 6, wherein the free end of each of the reinforcing pillars is substantially planar.

11. The case as recited in claim 6, further including our arrow holding means disposed within the interior compartment.

12. A case comprising:

first and second case sections connected for relative movement between open and closed positions;

the first case section including a first wall for defining a first interior recess, the first wall having a first mating rim;

the second case section including a second wall for defining a second interior recess, the second wall having a second mating rim;

the first and second mating rims having a structural configuration substantially defined by a chord portion intersecting an arc portion;

the first and second case sections each including at least one contiguous reinforcing pillar which projects into an interior compartment defined by the first and second interior recesses when the first and second case sections are disposed in the closed position;

each reinforcing pillar having a free end such that the free end of each at least one reinforcing pillar contiguous with the first case section is aligned with and contacts the free end of one of each at least one reinforcing pillar contiguous with the second case section when the first and second case sections are disposed in the closed position, wherein each reinforcing pillar tapers from a base to the free end.

13. The case as recited in claim 12, further including a handle formed along the arc portion of each first and second case section.

14. The case recited in claim 12, further including at least one latching device connected to one of the first and second case sections for engagement with the other of the first and second case sections.

15. The case as recited in claim 12, further including at least one comb member connected to at least one of the first and second case sections for removably mounting a plurality of arrows.

16. The case as recited in claim 12, wherein the free end of each of the reinforcing pillars is substantially planar.

17. A case comprising:

a first case section and a second case section connected for relative movement between an open position and a closed position, the first and second case sections jointly defining an interior compartment when disposed in the closed position; and arrow holding means disposed within the interior compartment for releasably holding a plurality of arrows, said arrow holding means including at least one comb member of elastomeric material and means for affixng said comb member to one of the first and second case sections, said comb member having an elongated base that includes a plurality of deflectable fingers interspersed at spaced locations therealong, adjacent ones of said fingers defining therebetween an arrow receiving groove configured to have a closed bottom end, an open top end, a first arrow receiving chamber adjacent said open top end, a second arrow receiving chamber adjacent said closed bottom end, and a narrowed passage therebetween; said fingers being deflectable to facilitate insertion and removal of arrow shafts to and from the first and second arrow receiving chambers.

18. The case as recited in claim 17, further including a set of reinforcing pillars contiguous with each of the first and second case sections which project into the interior compartment.

19. The case as recited in claim 18, wherein each reinforcing pillar has a free end which is defined substantially in a plane.

20. The case as recited in claim 18, wherein each reinforcing pillar has a free end, and the free end of each reinforcing pillar disposed in the first case section is aligned with the free end of one of the reinforcing pillars disposed in the second case section when the first and second case sections are disposed in the closed position.

21. A case comprising:

a first case section and a second case section connected for relative movement between an open position and a closed position, the first and second case sections defining an interior compartment when disposed in the closed position;

the first case section including a first shaped wall defining a first interior recess and having a first mating rim;

the second case section including a second shaped wall defining a second interior recess and having a second mating rim;

the first and second case sections each having a set of reinforcing pillars integrally formed therein which project into said interior compartment when the first and second case sections are disposed in the closed position;

said pillars each having a free end portion and a base portion, said base portion integrally merging with one of said first and second walls;

the free end of each reinforcing pillar formed in the first case section being aligned with the free end of one of the reinforcing pillars formed in the second case section when the first and second case sections are disposed in the closed position, wherein each reinforcing pillar is generally configured as a truncated cone which is wider at the base portion than at the free end portion;

wherein each of the first case section and the second case section is of common configuration and the first and second mating rims have a structural configuration substantially defined by an arc portion intersected by a chord portion.

22. The case as recited in claim 21, further including a handle section formed along the arc portion of each of the first and second case sections to define a gripping passage when the first and second case sections are disposed in the closed position.

23. The case as recited in claim 21, further including a plurality of feet formed on the first and second case sections adjacent the chord portion for supporting the case in an upright orientation.

24. A case comprising:

a first case section and a second case section connected for relative movement between an open position and a closed position, the first and second case sections defining an interior compartment when disposed in the closed position;

the first case section including a first shaped wall defining a first interior recess and having a first mating rim;

the second case section including a second shaped wall defining a second interior recess and having a second mating rim;

the first and second case sections each having a set of reinforcing pillars integrally formed therein which project into said interior compartment when the first and second case sections are disposed in the closed position;

said pillars each having a free end portion and a base portion, said base portion integrally merging with one of said first and second walls;

the free end of each reinforcing pillar formed in the first case section being aligned with the free end of one of the reinforcing pillars formed in the second case section when the first and second case sections are disposed in the closed position, wherein each reinforcing pillar is generally configured as a truncated cone which is wider at the base portion than at the free end portion;

wherein each of the first case section and the second case section is of common configuration and an arrow holding means is disposed within the interior compartment for removably mounting a plurality of arrows.

25. A case comprising:

a first case section and a second case section connected for relative movement between an open position and a closed position;

the first case section including a first shaped wall for defining a first interior recess, the first shaped wall having a first mating rim;

the second case section including a second shaped wall for defining a second interior recess, the second shaped wall having a second mating rim, the first and second case sections jointly defining an interior compartment when the first and second case sections are disposed in the closed position;

the first and second case sections each including at least one contiguous reinforcing pillar having a base and a free end, each said pillar projecting into the respective first and second interior recesses and tapering from the base to the free end;

a handle section formed along an arc portion of the mating rim of each of the first and second case sections to define a gripping passage when the first and second case sections are disposed in the closed position; and each reinforcing pillar disposed in the first case section being aligned with one of the reinforcing pillars disposed in the second case section when the first and second case sections are disposed in the closed position such that the aligned reinforcing pillars are in contacting relationship when a force is applied to one of the first or second case sections whereby a protective zone is defined within the interior compartment.

26. The case recited in claim 25, further including at least one latching device connected to one of the first and second case sections for engagement with the other of the first and second case sections.

27. The case as recited in claim 25, further including an arrow holding means disposed in the interior compartment for removably mounting a plurality of arrows.

28. The case as recited in claim 25, wherein the free end of each reinforcing pillar is structurally configured as defined in a plane.

* * * * *

UNITED STATES PATENT AND TRADEMARK OFFICE

CERTIFICATE OF CORRECTION

PATENT NO. : 6,571,946 B2 
DATED : June 3, 2003
INVENTOR(S) : Joseph F. Fiore, Jr. et al.

It is certified that error appears in the above-identified patent and that said Letters Patent is hereby corrected as shown below:

Title page,
Item [75], Inventors, add -- John J. Hagemann, Plano, IL --.

Column 9,
Line 3, delete "our" and replace with -- an --.

Signed and Sealed this

Twenty-third Day of August, 2005

JON W. DUDAS
*Director of the United States Patent and Trademark Office*